United States Patent [19]

Vaught

[11] 4,050,240

[45] Sept. 27, 1977

[54] VARIABLE AIR ADMISSION DEVICE FOR A COMBUSTOR ASSEMBLY

[75] Inventor: John M. Vaught, Indianapolis, Ind.

[73] Assignee: General Motors Corporation, Detroit, Mich.

[21] Appl. No.: 717,988

[22] Filed: Aug. 26, 1976

[51] Int. Cl.[2] ..... F02C 7/22

[52] U.S. Cl. ..... 60/39.65; 60/39.23; 431/352

[58] Field of Search ..... 60/39.65, 39.23; 431/351-353, 10

[56] References Cited

U.S. PATENT DOCUMENTS

| | | | |
|---|---|---|---|
| 3,765,171 | 10/1973 | Hagen et al. | 60/39.23 |
| 3,869,246 | 3/1975 | Hammond et al. | 60/39.65 |
| 3,930,368 | 1/1976 | Anderson et al. | 60/39.23 |
| 3,958,413 | 5/1976 | Cornelius et al. | 60/39.23 |

*Primary Examiner*—Carlton R. Croyle
*Assistant Examiner*—Robert E. Garrett
*Attorney, Agent, or Firm*—J. C. Evans

[57] ABSTRACT

A variable flow air controller for a gas turbine engine combustor has a rotatable band including a first plurality of slots formed therein that overlie a plurality of primary air admission slots in the combustor wall circumferentially therearound and directed radially into a primary combustion zone. The slots are arranged to form an open junction therebetween which shifts axially along the combustor assembly upon rotation of the band thereby to control the point of admission of primary air into a combustion apparatus for completing combustion at preselected positions downstream of a liner dome in accordance with engine operation.

2 Claims, 4 Drawing Figures

VARIABLE AIR ADMISSION DEVICE FOR A COMBUSTOR ASSEMBLY

This invention relates to combustion apparatus for gas turbine engines and more particularly to such apparatus including means for varying the direction of air flow into a combustion zone downstream of a liner dome portion of the assembly.

Various proposals have been suggested to control the location of primary air flow into a gas turbine engine combustion apparatus to assure efficient and low emission combustion of air fuel within the combustion apparatus.

One such arrangement is set forth in U.S. Pat. No. 3,869,246, issued Mar. 4, 1975, to Hammond et al, wherein spaced, reciprocable sleeves are operated by screw actuators to change the area and axial location of air flow into a combustion chamber of a gas turbine engine.

An object of the present invention is to provide an improved, compact air control assembly for changing the axial location of radial primary air ports into a primary combustion zone of a combustion apparatus by the provision of a single element selectively movable with respect to a plurality of fixed air flow slots wherein the unit includes a plurality of fixed air flow slots therein to traverse the fixed air flow slots in the combustor wall to continually shift the axial position of air flow into the combustion assembly.

Another object of the present invention is to provide a modified combustion apparatus including an air spray type fuel nozzle for directing fuel into an air cooled, annular walled combustion zone and wherein a plurality of elongated slots are formed in a combustion wall segment downstream of the zone in overlying relationship to the primary combustion zone of the combustion apparatus wherein each of the slots is formed at substantially a 45° angle with respect to the axis of the combustion apparatus and by the further provision of a single movable control band having a second plurality of elongated slots formed therein and overlapping the first plurality of slots to form a radial opening for flow of combustion air into the combustion apparatus; the second plurality of slots each being located perpendicularly with respect to the first plurality of slots and movable from one end to the opposite end of each of the first plurality of slots to shift the axial location of air flow into the combustion apparatus upon rotation of the movable band with respect to the combustion apparatus.

Further objects and advantages of the present invention will be apparent from the following description, reference being had to the accompanying drawings wherein a preferred embodiment of the present invention is clearly shown.

Figure 1:
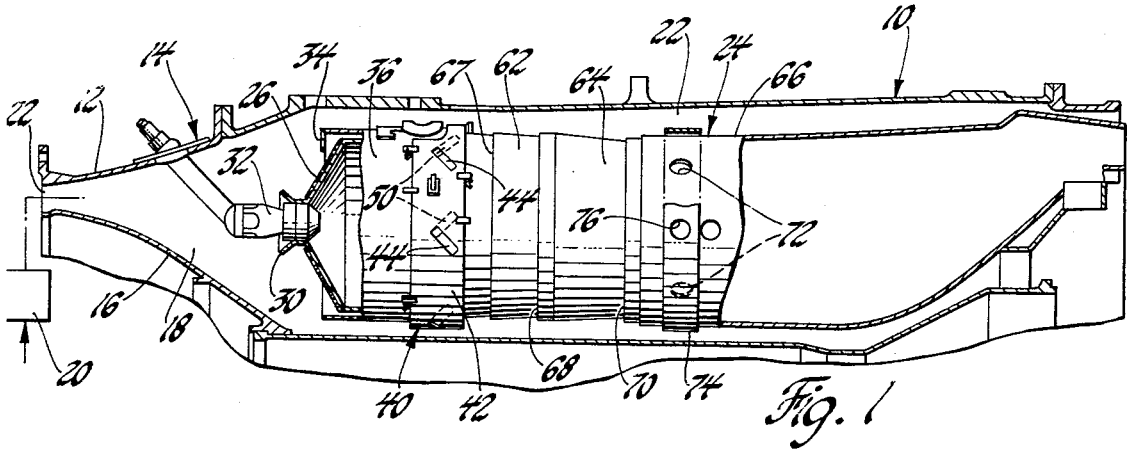
FIG. 1 is a longitudinal sectional view of a combustion apparatus taken in a plane containing the axis of the combustion liner with certain accessory components omitted.

Referring now to the drawing in FIG. 1, an outer housing 10 of a gas turbine engine is connected to an outer wall 12 of a diffuser assembly 14 having an inner wall 16 thereof defining a divergent diffuser space 18 for directing air from a gasifier compressor 20 into an annular chamber 22 in surrounding relationship to combustion apparatus 24 constructed in accordance with the present invention.

The combustion apparatus 24 includes an upstream liner dome 26 having two separate layers and including air openings 28 therein. A nozzle support ring 30 is connected to the dome 26 centrally thereof and is flared in an upstream direction to receive an air spray type fuel nozzle 32. A radially inwardly flanged sleeve 34 is located in surrounding relationship to the outer periphery of the dome 26 to provide a film of coolant air across the inside of a first combustion apparatus liner wall 36. The liner wall 36 is in surrounding relationship to a primary combustion zone 38 within the apparatus 24 downstream of the dome 26 to receive air fuel spray from the nozzle 32.

Figure 4:
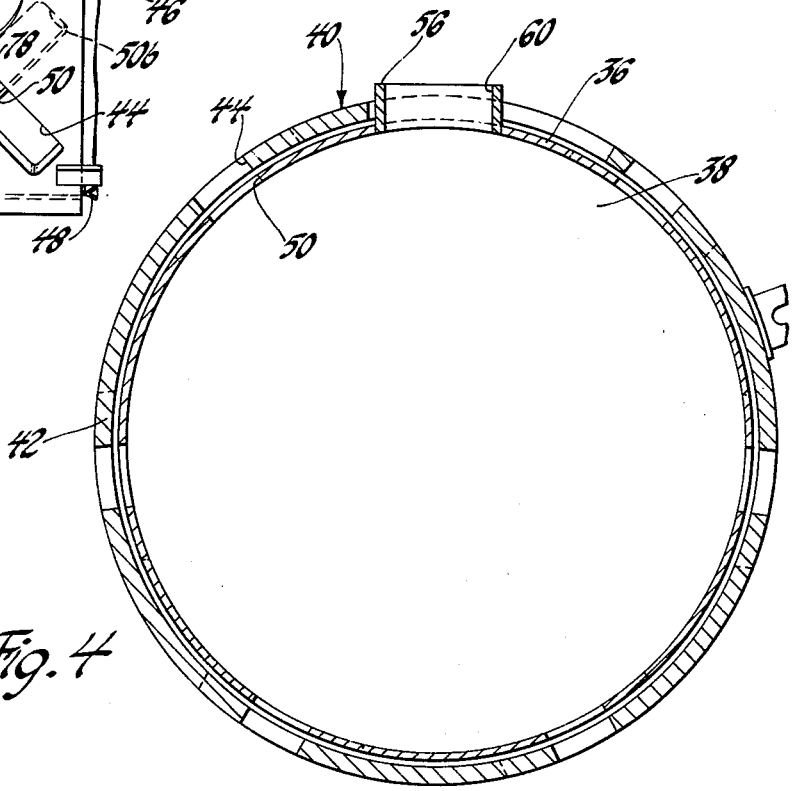
FIG. 4 is an enlarged vertical sectional view taken along the line 4—4 of FIG. 1.

Primary combustion air to the zone 38 is directed through an improved, variable geometry, primary air control device 40. It includes an annular band 42 located in spaced relationship to the outer periphery of the liner wall 36 as shown in FIG. 4. The band 42 includes a plurality of circumferentially spaced air flow slots 44 with major and minor axes therein, each elongated to have its major axis extend across the width of the band 42. Each of the slots 44 are arranged at substantially a 45° angle with respect to the center line of the combustion apparatus 24.

The band 42 includes a plurality of circumferentially spaced limit tabs 46 thereon that are positioned against stops 48 on the wall 36 to control maximum positions of rotation of the band 42.

Figure 2:
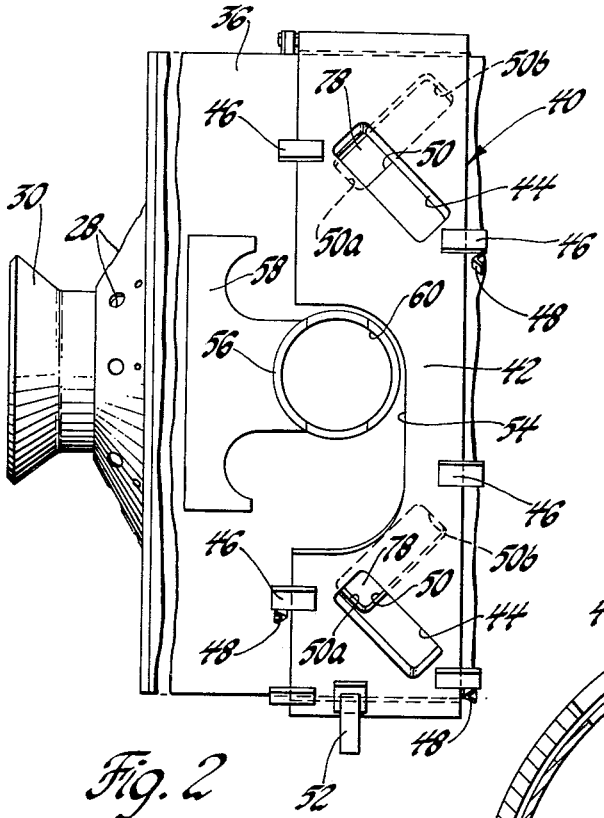
FIG. 2 is an enlarged, fragmentary elevational view of a variable geometry air control subassembly in the combination of FIG. 1.
Figure 3:
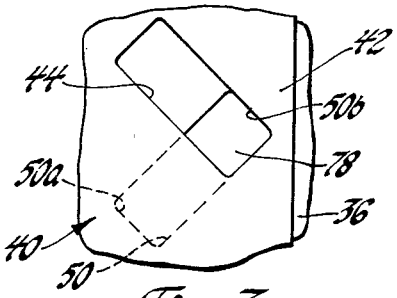
FIG. 3 is a fragmentary sectional view showing the relative relationship between slots in the band and slots in a combustion liner at a maximum axial downstream control position.

Each of the slots 44 is associated with a slot 50 with major and minor axes and formed at circumferentially located points within the liner wall 36. Each of the slots 50 is elongated to have a major axis like that of the slots 44. Each slot 50, furthermore, is located at a substantially 45° angle with respect to the center line of the combustion apparatus 24 thereby to define a right angular relationship between each of the associated slots 44 and 50 as shown in FIGS. 2 and 3. The band 42 has an operator lug 52 connected on one side thereof adapted to be connected to an external actuator for moving the limit tabs 46 from the stops 48 as shown in FIG. 2 into a second position wherein the tabs 46 engage stops 48 to locate the slots 44 with respect to the slots 50 at the opposite end thereof as shown in FIG. 3.

In the illustrated arrangement the band 42 is shown as having a side recess 54 along the upstream edge thereof that accommodates a circular boss 56 having a reinforcement 58 to supportingly receive a combustion apparatus igniter (not shown) for insertion into an access opening 60 into the combustion zone 38.

The combustion apparatus further is characterized by having a plurality of downstream wall segments 62, 64, 66 with annular air passages 67, 68, 70 located respectively at the interface of each of the liner wall segments to provide a flow of coolant air flow across the inner surface thereof. The downstream liner wall segment 66 has a plurality of dilution holes 72 therein through which dilution air will flow into the interior of the combustion apparatus. If desired, an annular band 74, with circular openings 76 therein can be rotated concurrently with the band 42 to proportion the dilution air flow into the combustion apparatus 24 in accordance with the primary air flow pattern through the air control device 40.

Under a first mode of operation the air control device 40 is located as shown in FIG. 2 and the slots 44 are located at an upstream end 50*a* of each of the slots 50 as shown in FIG. 2 to define a generally square radial port 78 from whence primary air is directed from the chamber 22 to a point within the primary combustion zone 38 a short distance upstream from the outlet of the air spray nozzle 32. The axial extent of a mixing zone between the outlet of the nozzle 32 and the flow or primary air into the zone 38 is minimized when the control device 40 is in the aforesaid position thereby to combust reduced fuel flow into the combustion apparatus 24.

The band 42 can be moved into an infinite number of positions between that shown in FIG. 2 and a maximum stop position shown in FIG. 3 wherein the slot 50 is positioned in overlying relationship adjacent a downstream end 50*b* of each of the slots 50 as shown in FIG. 3. The area of the rectangular opening 78 for radial flow of combustion from space 22 into the zone 38 remains constant as it is shifted axially downstream to increase the size of the mixing zone between the air spray nozzle 32 and the point of entry of the primary combustion air into the primary combustion zone 28 thereby to assure complete combustion of increased air fuel quantities flowing into the combustion apparatus 24.

Intermediate axial positions of the radial openings 78 defined by the overlap between the slots 44, 50 will be obtained between the aforedescribed maximum stop position.

The apparatus permits a wide variance in axial location of primary air ports into the primary combustion zone 38 by use of a single control element and the area of the air flow port to the primary zone 38 will be maintained constant.

While the embodiments of the present invention, as herein disclosed, constitute a preferred form, it is to be understood that other forms might be adopted.

The embodiments of the invention in which an exclusive property or privilege is claimed are defined as follows:

1. A combustor assembly comprising a liner having an inlet and an outlet, a dome overlying the inlet and including means forming a passage for flow of primary combustion air into the liner, a fuel nozzle for directing fuel spray into a reaction mixing zone downstream of said dome, a plurality of slots with major and minor axes formed in said liner downstream of said dome, each of said slots having its major axis formed at an angle to the longitudinal axis of said liner, a control band rotatably supported on said liner in overlying relationship to said slots, a second plurality of slots in said band each having a major and minor axis, each of said second slots having its major axis intersecting the major axis of one of the first plurality of slots, said band being rotatable to cause first and second slots to define a radially overlapped opening for flow of primary combustion air into the liner downstream of said dome, said radially overlapped opening being axially shiftable on said liner in response to rotation of said band to alter the location of primary air admission with respect to the fuel spray and to alter the axial extent of the mixing zone between the dome and the overlapped radial opening.

2. A combustor assembly comprising a liner having an inlet and an outlet, a dome overlying the inlet and including means forming a passage for flow of primary combustion air into the liner, a fuel nozzle for directing fuel spray into a reaction mixing zone downstream of said dome, a plurality of slots with major and minor axes formed in said liner downstream of said dome, each of said slots having its major axis formed at an angle to the longitudinal axis of said tubular liner, a control band rotatably supported on said liner in overlying relationship to said slots, a second plurality of slots in said band each having a major and minor axis, each of said second slots having its major axis intersecting the major axis of one of the first plurality of slots in a right angular relationship, said band being rotatable to cause said first and second slots to define a radially overlapped opening for flow of primary combustion air into the liner downstream of said dome, said radially overlapped opening being axially shiftable on said liner in response to rotation of said band to alter the location of primary air admission with respect to the fuel spray and to alter the axial extent of the mixing zone between the dome and the overlapped radial openings.

* * * * *